US006463591B1

(12) United States Patent
Toratani

(10) Patent No.: US 6,463,591 B1
(45) Date of Patent: Oct. 15, 2002

(54) CLOTHING SUCH AS SHORTS AND BATHING SUIT

(76) Inventor: Ikuo Toratani, 28-4, Aza-Matsuhama Ni, Nanatsukacho, Kahoku-gun, Ishikawa 929-1172 (JP)

( * ) Notice: Subject to any disclaimer, the term of this patent is extended or adjusted under 35 U.S.C. 154(b) by 0 days.

(21) Appl. No.: 09/744,327

(22) PCT Filed: May 26, 1999

(86) PCT No.: PCT/JP99/02778

§ 371 (c)(1),
(2), (4) Date: Jan. 23, 2001

(87) PCT Pub. No.: WO00/72707

PCT Pub. Date: Jul. 12, 2000

(51) Int. Cl.[7] ..... A41D 5/00
(52) U.S. Cl. ..... 2/67; 2/400
(58) Field of Search ..... 2/67, 400–408, 2/228, 238, 227; 450/96, 97, 104, 115–118, 134; 604/384.6–395

(56) References Cited

U.S. PATENT DOCUMENTS 2,465,913 A * 3/1949 Murdock ..... 2/406
2,834,020 A * 5/1958 Warten ..... 2/406
3,490,075 A * 1/1970 Abbott ..... 2/406
3,852,828 A * 12/1974 Silverstein ..... 2/406 X
4,205,397 A * 6/1980 Michele ..... 2/67
5,182,815 A * 2/1993 Young ..... 2/406
5,708,986 A * 1/1998 Belardinelli ..... 2/406

FOREIGN PATENT DOCUMENTS

JP 62-141101 A 6/1987
JP 3003595 U 8/1994
JP 3022949 U 1/1996
JP 9-316708 A 12/1997

* cited by examiner

*Primary Examiner*—Gloria M. Hale
(74) *Attorney, Agent, or Firm*—Griffin & Szipl, P.C.

(57) ABSTRACT

The invention provides clothing wherein the hip hemline is prevented from rising during bending and stretching. When standing, loose wrinkles and bagginess in the buttock lower portion is not produced. Lower end portions of right and left edges of a front body, wherein leg openings are bilaterally formed, intersect with hip hemline lower end portions. Lower end portions of right and left edges downwardly extend from vertical intermediate positions in an outward convex curved line (16*a*). Portions (16*b*) of curves (16*a*) lower than a vertical intermediate position are linear or curved shape. A back body has lower portions (19*a*) of right and left edges that extend spreadingly downward from a vertical intermediate position. Seamlines between right and left edges of the front body and corresponding edges of the back body elongate from back waist portions to the hip hemlines with an outward detouring around the top of the buttock.

2 Claims, 9 Drawing Sheets

CLOTHING SUCH AS SHORTS AND BATHING SUIT

TECHNICAL FIELD

The present invention relates to a clothing such as shorts, briefs, or a bathing suit.

BACKGROUND ART

When the posture of a person is changed from a standing posture to a sitting posture, a bending or crouching posture, or the like, the shape of the lower half of the buttock is largely changed, and the skin of the lower half portion of the buttock is well stretched. According to measurement examples, in a standing posture, the vertical distance of the skin from the gluteal groove portion to the vicinity of the top of the buttock of a person of ordinary physique is 15 cm, and, in a sitting posture, the distance is increased to 25 cm. In usual shorts or a bathing suit, the hip hemline (an approximately rear half of the inner periphery of a leg opening) is in a position where the skin of the lower half portion of the buttock is stretched and contracted at the highest degree, and hence unstable. When shorts 10 are worn, as shown in FIG. 7, a hip hemline 15*a* of the shorts gradually rises in a direction from a position C to a position D, thereby producing discomfort. Therefore, the rising hip hemline 15*a* is sometimes pulled down by hand.

Conventionally, as means for preventing such rising of a hip hemline of shorts from occurring by means of patterning (a cutting method), for example, there are the following means. As shown in FIG. 9 in which a front body 11, a back body 12, and a gusset 13 are shown in developed form, cutting is performed so that the hip hemline 15*a* of the inner periphery of a leg opening 15 of the back body 12 is extended toward the center of the leg opening as indicated by the broken line F, and dart seams are formed so that an envelope for the buttocks is deep. Alternatively, as shown in FIG. 10, a back body 30 and a side piece 31 are sewn so as to pass over the top T of the buttock extending from a waist portion 32 to a hip hemline 33, and a dart which is long and large is formed between the back body 30 and the side piece 31, thereby enveloping the buttocks (Japanese Utility Model Registration No. 3022949).

However, in the means in which, as shown in FIG. 9, the hip hemline 15*a* of the back body 12 is cut in form that is extended toward the center of the leg opening 15 so as to deepen the envelope for the buttocks, the portion which is stretched in a sitting posture is formed into loose wrinkles in a standing posture, so that the appearance is often impaired.

In the means in which, as shown in FIG. 10, a dart which is long and large is obtained by the cutting method wherein the seamline L of the back body 30 passes over the top T of the buttock extending from the waist portion 32 to the hip hemline 33, the whole of the protruding buttocks can be fully enveloped. Even when the hip size is identical, however, the hip shape is widely varied, and hence few persons have a hip shape just fitting to the hip portion. In the portion of the seamline L passing over the top T of the buttock, the flexibility of even a stretchable fabric itself is reduced by half. Therefore, the motion of the top T of the buttock which is caused by a sitting or rising operation is suppressed by the portion of the seamline L. In order that the hip hemline 33 is satisfactorily prevented for every person from rising in accordance with a motion of the buttock top T, therefore, a dart which is long and large must be formed between the back body 30 and the side piece 31. In this configuration, however, the dart portion which fits to the buttock in a sitting posture is loosened when the posture is changed to a standing posture, so that many loose wrinkles and bugginess are caused in the buttock lower portion and the gluteal groove portion, thereby impairing the beauty of the hip hemline.

In other words, in the cutting method wherein the seamline L of the back body 30 passes over the buttock top T as shown in FIG. 10, when it is intended to reduce such loose wrinkles and bugginess in the buttock lower portion and the gluteal groove portion, it is impossible to envelop the buttocks widely and deeply, and the effect of preventing the hip hem from rising is reduced by half.

In the shorts shown in FIG. 10 which is configured so that the seamline L of the back body 30 passes over the buttock top T, the portion of the seamline L of the back body 30 is closely contacted with the buttock top T which protrudes at the highest degree, particularly in a sitting posture, where by a sense of discomfort is produced and the sense of touch is lowered. Furthermore, this causes an adverse effect that, when a person wears an outer garment which is tight and thin, a line elongating along the seamline L easily appears in a prominent manner on the outer garment and tends to attract attention.

DISCLOSURE OF INVENTION

The invention has been conducted in order to solve the problems of the conventional art. It is an object of the invention to provide a clothing such as shorts or a bathing suit in which a hip hemline can be surely prevented from rising, loose wrinkles and bugginess in the buttock lower portion and the gluteal groove portion are hardly produced in a standing posture, a beautiful hip hemline is obtained, and the wearing feeling is improved.

The clothing such as shorts or a bathing suit of the invention is characterized in that, as shown in FIGS. 4 and 8, lower end portions of right and left edges 16, 16 of a stretchable front body 11 in which leg openings 15 that are downward opened are formed in a bilaterally symmetrical manner intersect with lower end portions of hip hemlines 15*a*, 15*a* of inner peripheries of the right and left leg openings, portions of the right and left edges 16, 16 and extending from vertical intermediate positions to the lower end portions are cut in a form which is connected by a curved edge 16*a* that is outward convex, portions 16*b* of the curved edges 16*a* which are lower than a vertical intermediate position are formed into a linear or curved shape, portions 19*a* of right and left edges 19, 19 of a stretchable back body 12 are cut into a shape which is spread as moving downward, the portions extending from vertical intermediate positions to lower end portions, a width (P) between the lower end portions of the right and left edges 19, 19 of the back body 12 is set to be equal to or larger than 0.6 times and equal to or smaller than 6 times a width (H) between the lower end portions of the right and left edges 16, 16 of the front body 11, the right and left edges 19, 19 of the back body 12 and the right and left edges 16, 16 of the front body 11 are sewn to each other, and, as shown in FIG. 5, seamlines L are formed so as to elongate from back waist portions 24 and 25 to the hip hemlines 15*a* with outward detouring around a top T of the buttock.

In a clothing which is obtained by performing setting, cutting, and sewing as described above, it is possible to obtain adequate three-dimensional bulges which are similar to the body shape in the vicinity of the hip hem, in a non-worn state. In a worn state, therefore, the hip hemline can deeply fit to the gluteal groove portion to deeply envelop the buttock lower portion, so that, even when the wearer moves, for example, vigorously bends at the waist, the hip hemline can be surely prevented from rising.

Particularly, the seamlines of the front body and the back body have a pattern which outward detours around the buttock top so as to avoid the top. Even when a pattern in which the hip hemline is downward elongated so as to deeply envelop the buttock lower portion is employed, therefore, loose wrinkles and bugginess in the buttock lower portion and the gluteal groove portion are hardly produced in a standing posture, and the buttocks can be enveloped widely and deeply, unlike the above-mentioned conventional art clothing in which the seamlines of the front body and the back body pass over the buttock top.

When the seamlines of the front body and the back body outward detour around the buttock top so as to avoid the top as described above, the buttock top can ensure the stretchability of the fabric itself of the buttock top of the back body. This stretchability enables the clothing to satisfactorily cope with motion of the buttock top. Therefore, the length and the size of darts required for preventing the rising can be made smaller than those of darts required in the case where the seamlines of the back body pass over the buttock top. In a standing posture, consequently, loose wrinkles and bugginess are hardly produced in the buttock lower portion and the gluteal groove portion, and a beautiful hip hemline can be obtained.

When the seamlines of the back body pass a lower place outside the buttock top which protrudes at the highest degree, so as to avoid the top, a sense of discomfort due to the seamlines is hardly produced even in a sitting posture, and, even when a person wears an outer garment which is tight and thin, lines elongating along the seamlines appear in a less prominent manner on the outer garment as compared with the case where the seamlines pass the highest top of the buttock.

BEST MODE FOR CARRYING OUT THE INVENTION

Figure 1:
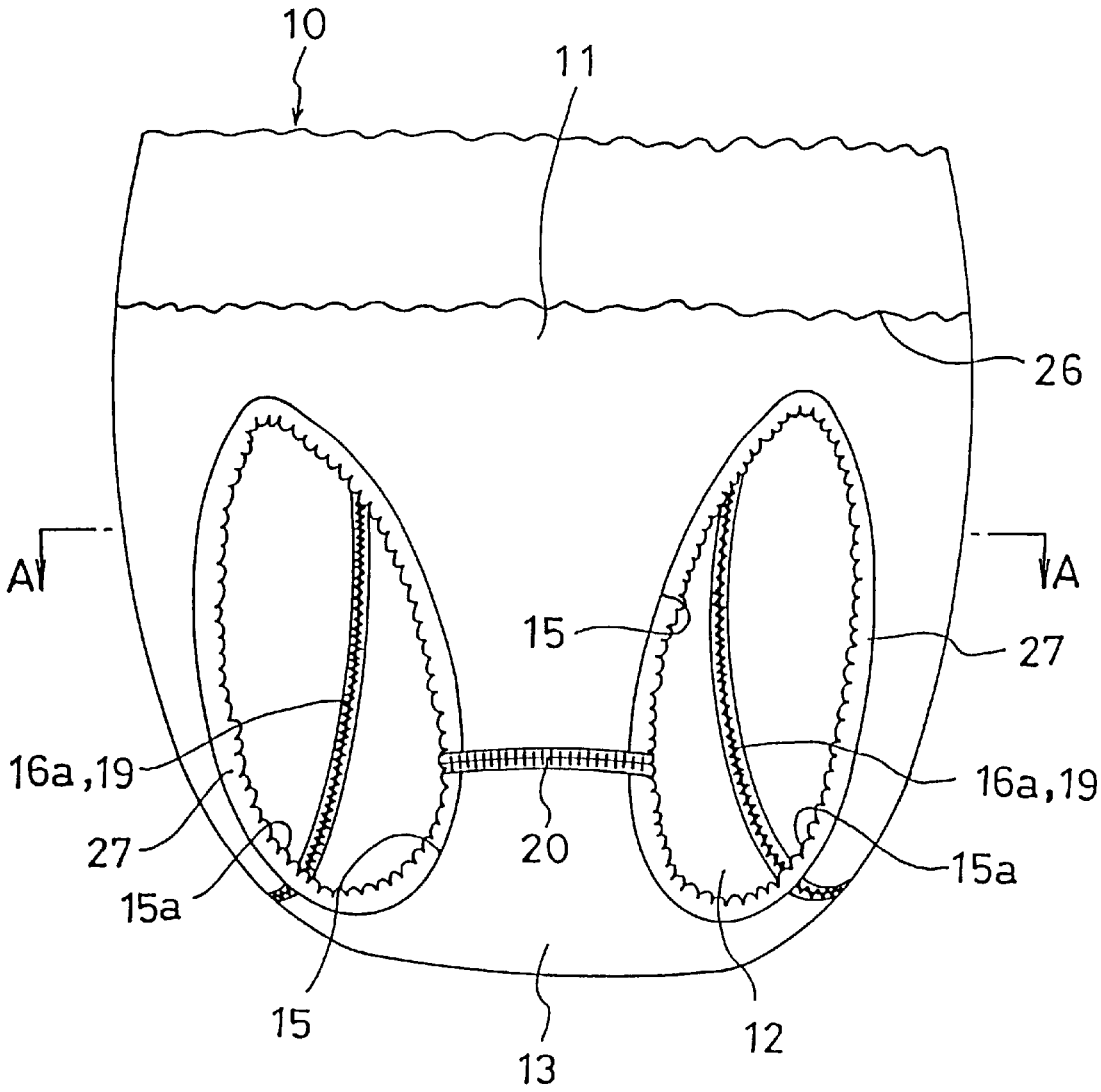
FIG. 1 is a front view of shorts of an embodiment of the invention.
Figure 2:
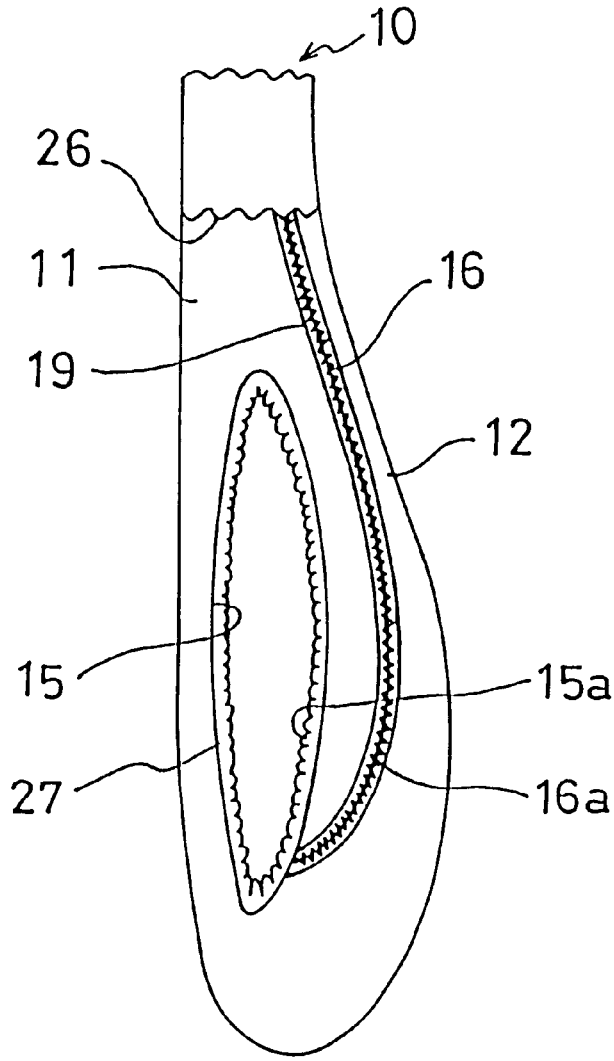
FIG. 2 is a side view of the shorts.
Figure 3:
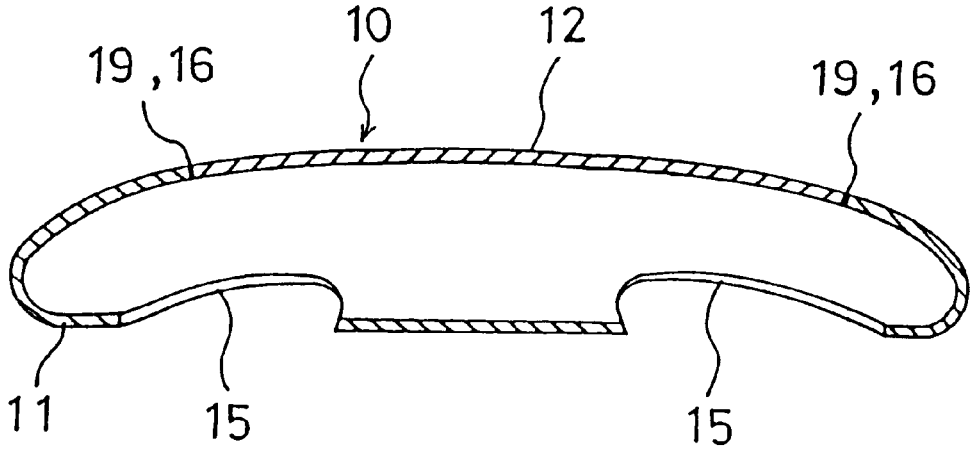
FIG. 3 is a section view taken along the line A—A in FIG. 1.
Figure 4A:
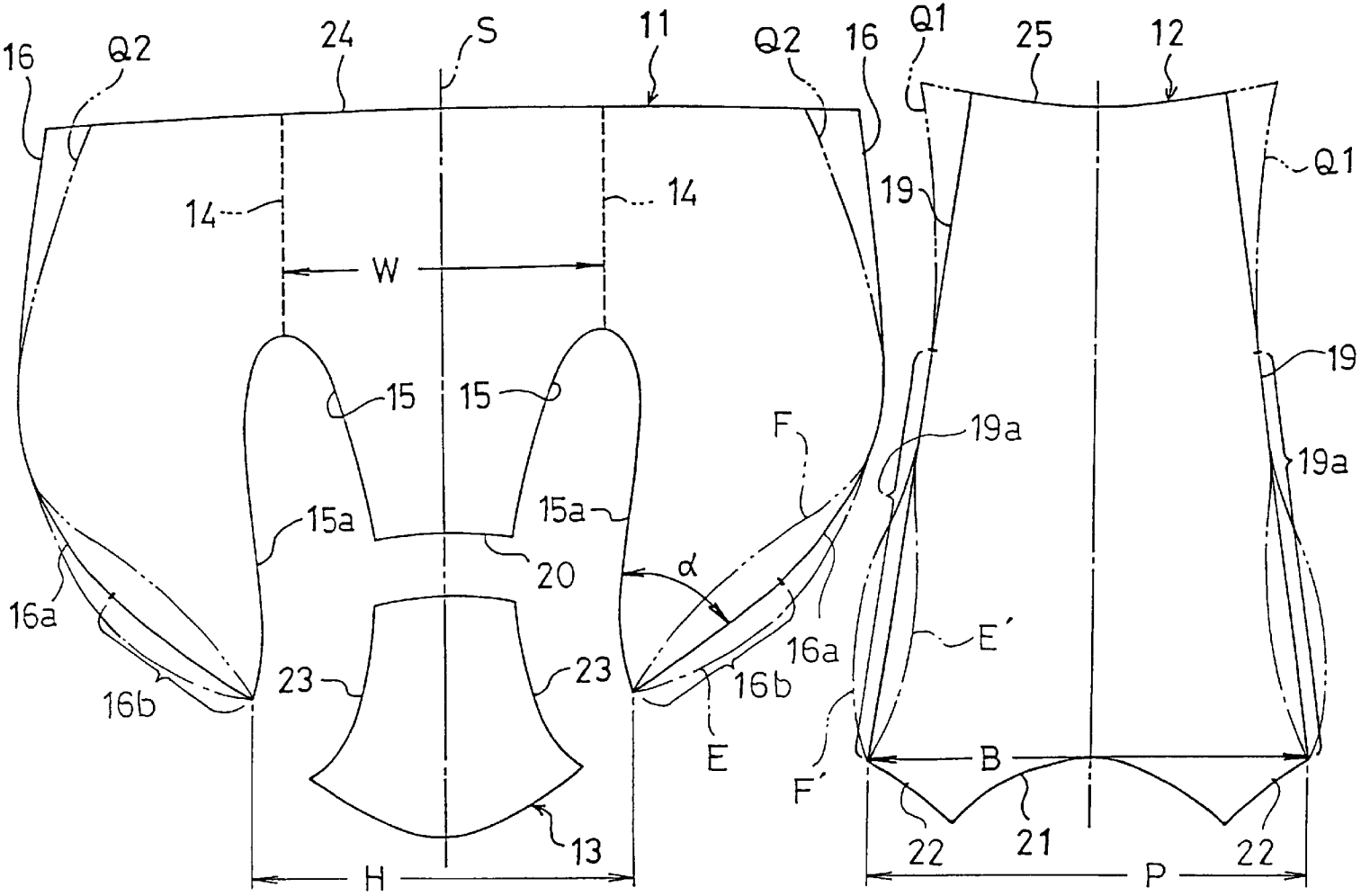
FIG. 4A is a development plan view of a front body, a back body, and a gusset of the shorts.
Figure 5:
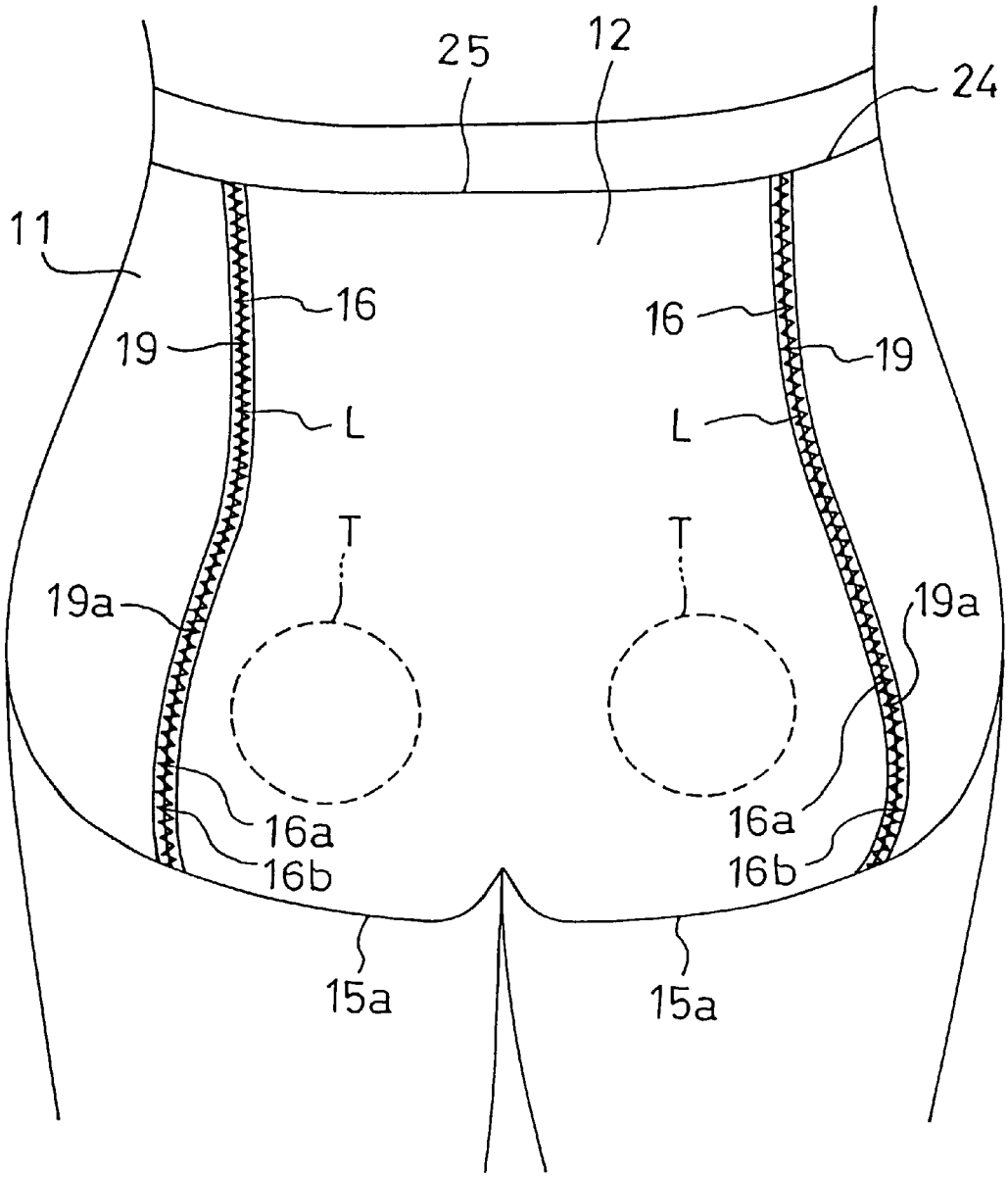
FIG. 5 is a rear view showing the shorts of FIG. 4A in a worn state.

FIG. 1 is a front view of shorts of an embodiment of the invention, FIG. 2 is a side view of the shorts, FIG. 3 is a section view taken along the line A—A in FIG. 1, FIG. 4A is a development plan view of a front body, a back body, and a gusset of the shorts, and FIG. 5 is a rear view showing the shorts of FIG. 4A in a worn state.

In the shorts 10, the front body 11, the back body 12, and the gusset 13 which are shown in developed form in FIG. 4A are used as main configuring members. The members are made of stretchable fabric.

Referring to FIG. 4A, the front body 11 is cut so as to have a width which is larger than the width W between side lines 14, 14. In the lower end portion, leg openings 15, 15 which are downward opened are formed by cutting in a bilaterally symmetrical manner. In the illustrated example, the cutting is deeply performed so as to form the leg openings 15 for high-cut legs in a downward opening shape. A hip hemline 15*a* which occupies a substantially rear half of the inner periphery of each of the leg openings 15 is formed in substantially parallel to the front center line S. Lower end portions of right and left edges 16, 16 of the front body 11 are formed so as to intersect with lower end portions of the hip hemlines 15*a*, 15*a* of the leg openings 15, 15.

Figure 6:
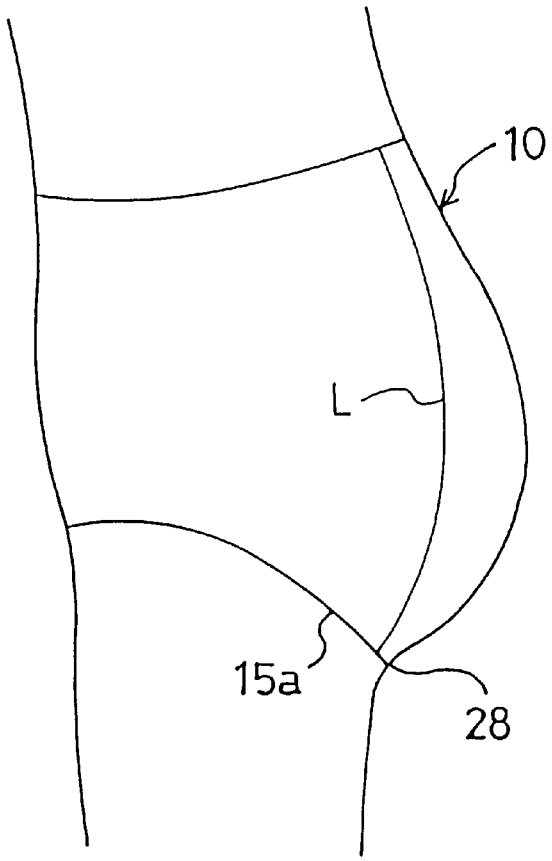
FIG. 6 is a side view showing a worn state of shorts in a standing posture.

Portions of the right and left edges 16, 16 of the front body 11 and extending from vertical intermediate positions to the lower end portions are formed into arcuately curved edges 16*a* which are outward convex. The curves of the curved edges 16*a* are employed in order to form a shape which is similar as far as possible to a curve R of the buttock lower portion that is drawn when the wearer sits on a chair, as shown in FIG. 6. When the radius of the whole curved edges 16*a* is small, loose wrinkles are easily produced in the places in a standing posture. In order to solve this, preferably, portions 16*b* (portions covering places which are immediately above the gluteal groove portion) of the curved edges 16*a* which are lower than a vertical intermediate position are formed into a linear or gently curved shape. In shorts of an ordinary size, preferably, an angle $\alpha$ formed by the hip hemline 15*a* and the lower portion 16*b* of the curved edge 16*a* is set to 25 to 80°, more preferably 45 to 60°.

On the other hand, the back body 12 is cut so that right and left edges 19, 19 of the back body are cut into an inclined shape which is spread as moving downward. In this case, it is not always necessary to form the right and left edges 19, 19 into a shape which is straight over the whole length extending from the waist portion 25 to the lower end portion. It is requested that at least portions 19*a* extend from the vertical intermediate position to the lower end portion are cut into a shape which is spread as moving downward. For example, the portions may be arbitrarily formed as curves such as E and E' indicated by the single-dashed line in FIG. 4A, or those such as F and F' indicated by the double-dashed line in the figure.

The portion of each of the right and left edges 19, 19 extending from the waist portion 25 to the vertical intermediate position can be arbitrarily drawn into an inclined line, a curved line, or the like. For example, the portion may be formed into an arcuate edge as indicated by the double-dashed line $Q_1$ in FIG. 4A. In this case, in accordance with the formation, the portion of each of the right and left edges 16, 16 of the front body 11 which extends from a waist portion 24 to the vertical intermediate position is cut as indicated by the double-dashed line $Q_2$.

The front body 11 and the back body 12 which are cut in this way are formed into a tubular shape by sewing together the right and left edges 16, 16 and 19, 19. An inner crotch front portion 20 which is formed into a concave arcuate shape in the center of the lower end of the front body 11, and an inner crotch rear portion 21 which is similarly formed into a concave arcuate shape in the center of the lower end of the back body 12 are connected to each other by the gusset 13. The downward opening portions of the leg openings 15 of the front body 11 are connected to each other in an endless manner by inclined lower edges 22 through which the lower ends of the lower portions 19*a* of the back body 12 and the inner crotch rear portions 21, and edges 23 of the gusset 13.

Figure 4B:
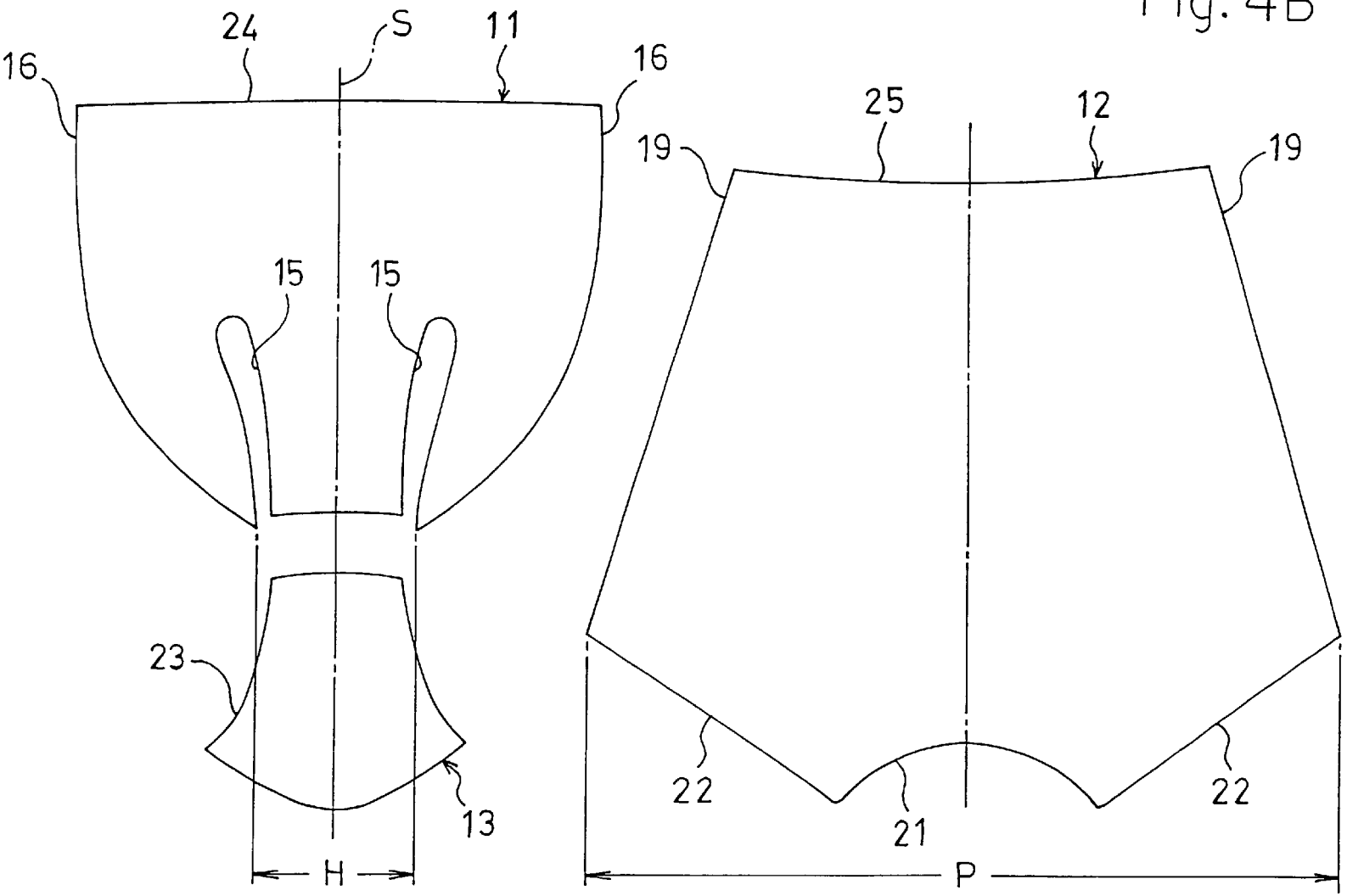
FIG. 4B is a development plan view of a front body, a back body, and a gusset of another example of shorts.

It should be noted that, as shown in FIG. 5, seamlines L between the right and left edges 16, 16 of the front body 11, and the right and left edges 19, 19 of the back body 12 are formed. so as to, in a worn state, elongate from places outside the back waist portions 24 and 25 to outward detour around the top T of the buttock and then reach the hip hemline 15*a*. In order to realize this, the width P between the lower end portions of the right and left edges 19, 19 of the back body 12 is set to be equal to or larger than 0.6 times and equal to or smaller than 6 times the width H between the lower end portions of the right and left edges 16, 16 of the front body 11. In FIG. 4A, the widths P and H are set to be approximately equal to each other. FIG. 4B shows the case where the width P is set to be about 6 times the width H.

Furthermore, as shown in FIG. 1, stretch lace 26 is sewn to the waist portions 24 and 25 of the front body 11 and the back body 12, and strip-like rubber 27 is sewn to the leg openings 15.

Figure 7:
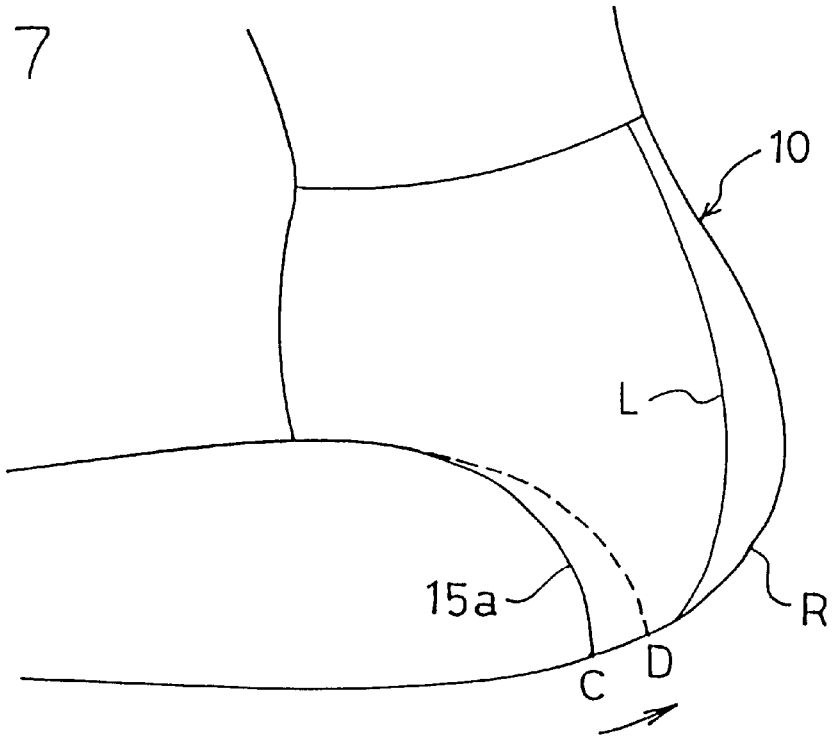
FIG. 7 is a side view showing a worn state of shorts in a sitting posture.

In the thus sewn shorts 10, as shown FIGS. 2 and 3, adequate three-dimensional bulges which are similar to the body shapes of the buttock lower portions and the gluteal groove portion are formed in the vicinity of the hip hem. As shown in FIG. 6, therefore, the hip hemline 15*a* can deeply fit to the gluteal groove portion 28 to deeply envelop the buttock lower portion. Even when the wearer moves, for example, sits on a chair or vigorously bends at the waist, the hip hemline 15*a* can be surely prevented from rising from the position C of FIG. 7 to the position D.

Figure 10:
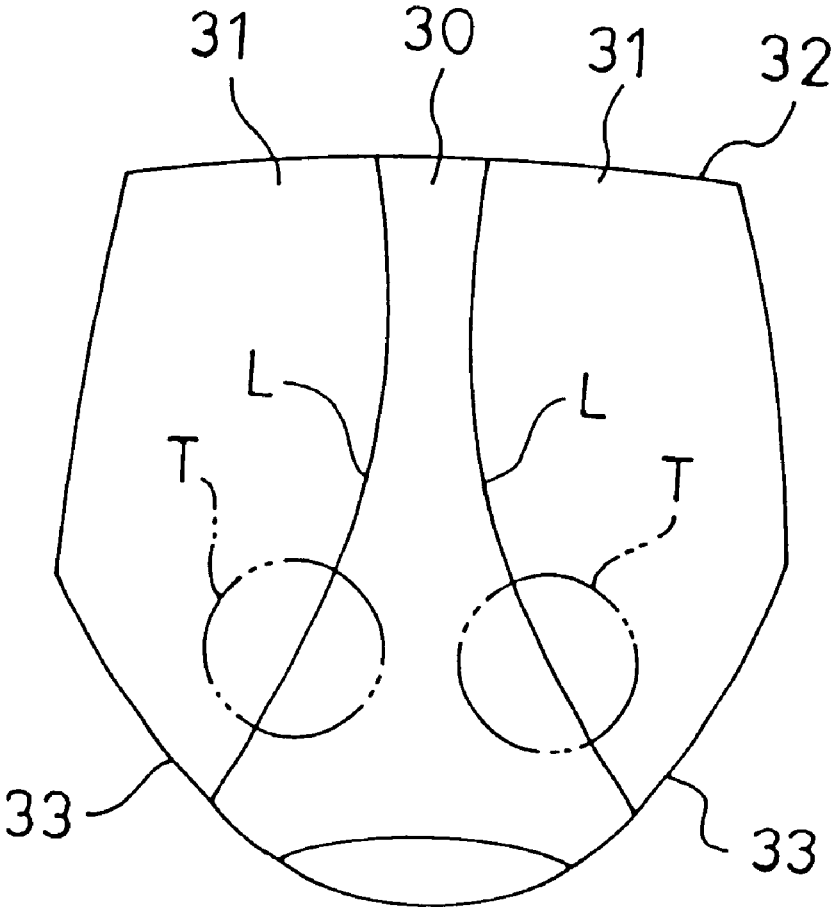
FIG. 10 is a rear view of shorts of another conventional art example.

Particularly, the seamlines L of the front body 11 and the back body 12 have a pattern which outward detours around the buttock top T so as to avoid the top T. Even when a pattern in which the hip hemline is downward elongated so as to deeply envelop the buttock lower portion is employed, therefore, loose wrinkles and bugginess in the buttock lower portion and the gluteal groove portion are hardly produced in a standing posture, and the buttocks can be enveloped widely and deeply, unlike the conventional art clothing in which the seamlines L of the front body 11 and the back body 12 pass over the buttock top T as shown in FIG. 10.

Since the seamlines L of the front body 11 and the back body 12 outward detour around the buttock top T so as to avoid the top T, the stretchability of the fabric itself of the buttock top T of the back body 12 can be ensured. This stretchability enables the clothing to satisfactorily cope with vigorous motion of the buttock top T. Therefore, the length and the size of darts required for preventing the rising can be made smaller than those of darts required in the case where the seamlines L of the back body 30 pass over the buttock top T as shown in FIG. 10. As a result, in a standing posture, loose wrinkles and bugginess are hardly produced in the buttock lower portion and the gluteal groove portion, and the beautiful hip hemline 15*a* can be obtained. Furthermore, a sense of discomfort due to the seamlines L is hardly produced even in a sitting posture. Even when a person wears an outer garment which is tight and thin, lines elongating along the seamlines L appear in a less prominent manner on the outer garment as compared with the case where the seamlines pass the highest top T of the buttock.

Figure 8:
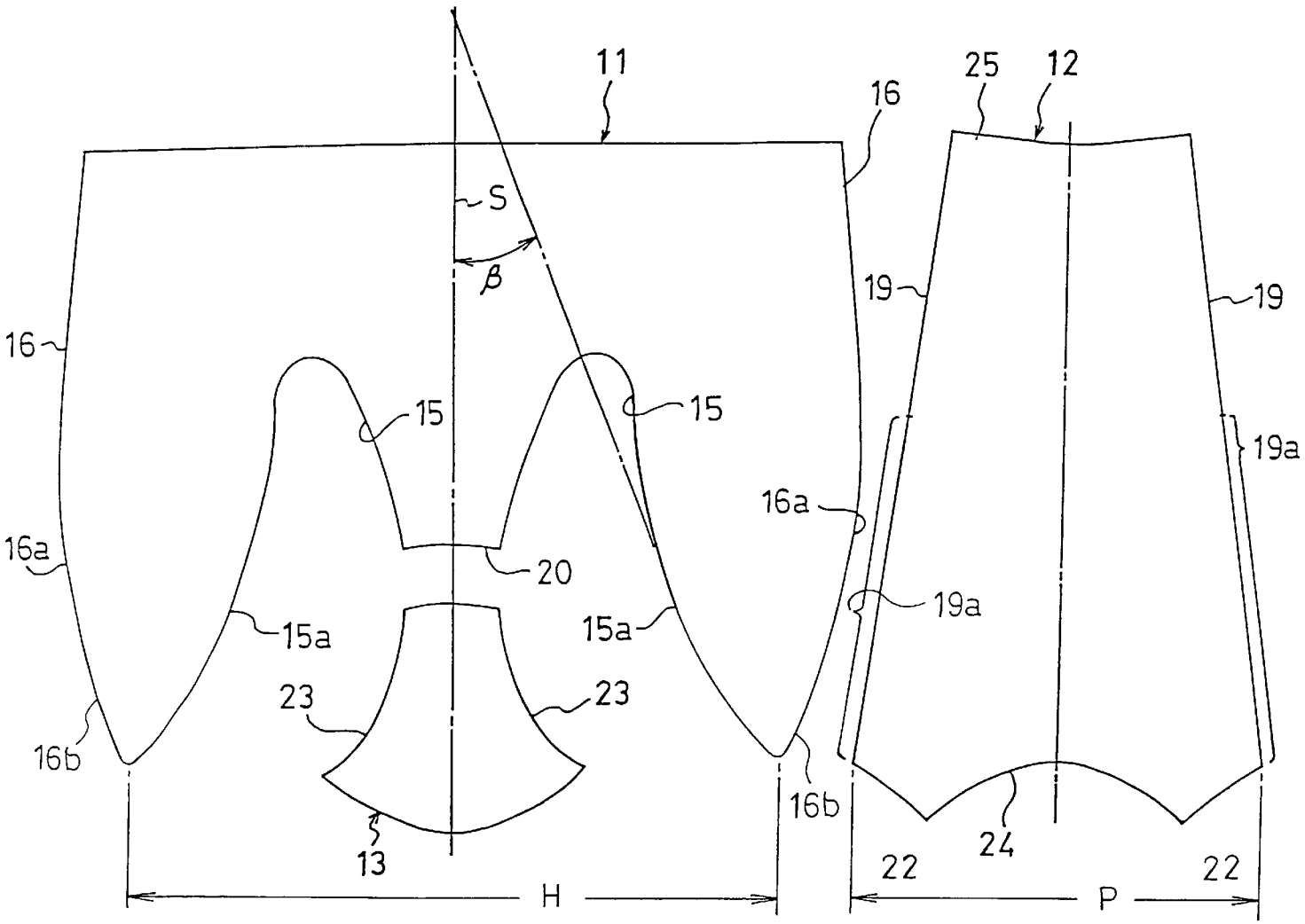
FIG. 8 is a development plan view of a front body, a back body, and a gusset of shorts of another embodiment of the invention.
Figure 9:
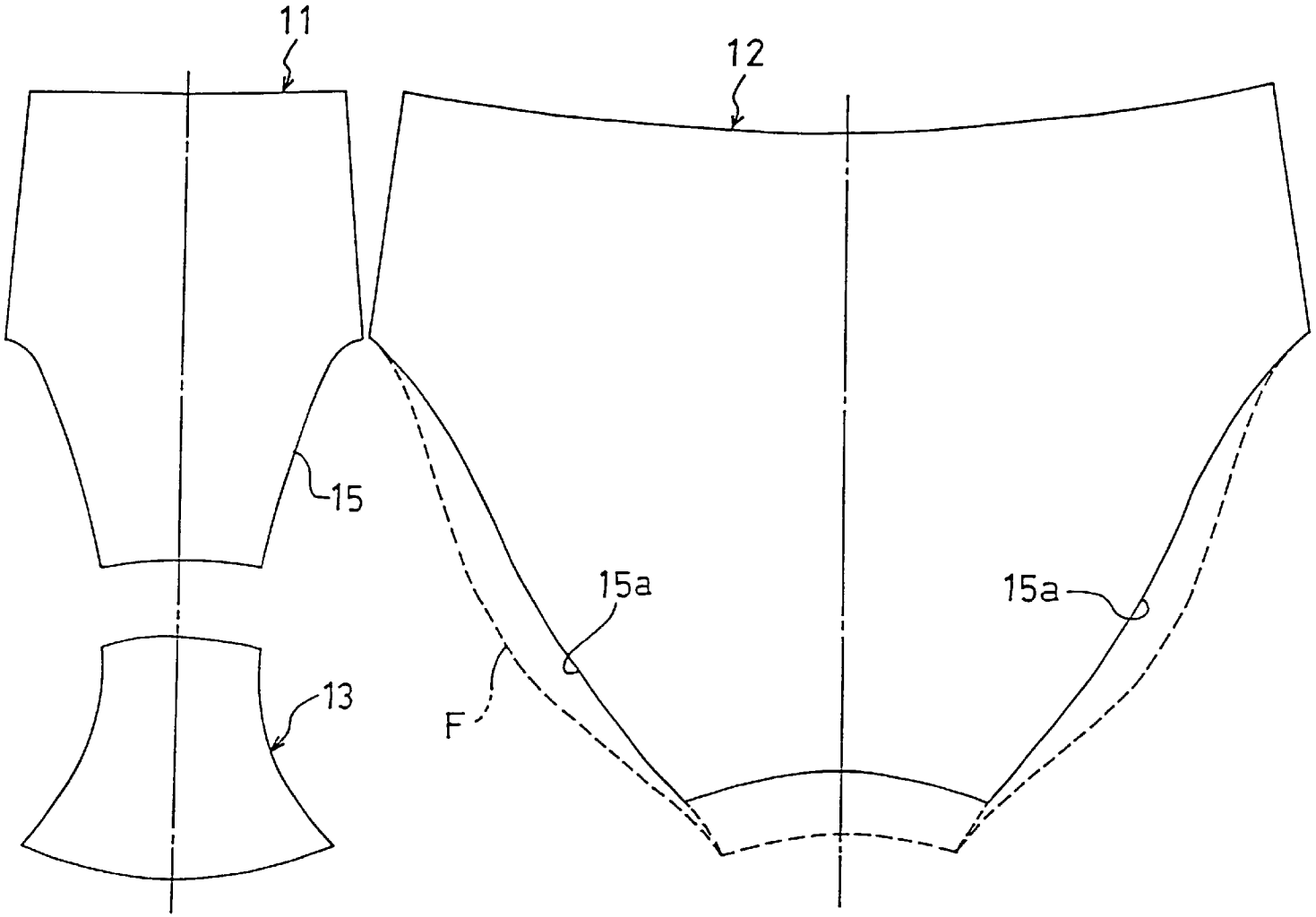
FIG. 9 is a development plan view of a front body, a back body, and a gusset of shorts of a conventional art example.

FIG. 8 is a development plan view of a front body, a back body, and a gusset of shorts of another embodiment of the invention. In the embodiment, the whole curved edges 16*a* of the front body 11 are formed by curves which are relatively more gentle than the curves of the whole curved edges 16*a* of the above-described embodiment. In contrast to the above-described embodiment in which the hip hemlines 15*a* of the leg openings 15 are formed in substantially parallel to the front center line S, in the embodiment, the hip hemlines 15*a* of the leg openings 15 of the front body 11 are formed to be substantially symmetrical with the curved edges 16*a*, and an angle β formed by the front center line S and an extended line of each of the hip hemlines 15*a* is set to 40° or smaller, more preferably 35°. The width P between the lower end portions of the right and left edges 19, 19 of the back body 12 is set to be about 0.65 times the width H between the lower end portions of the right and left edges 16, 16 of the front body 11. The other points such as the shape of the back body 12, and that, in a worn state, the seamlines L of the front body 11 and the back body 12 elongate from places outside the back waist portions to outward detour around the top T of the buttock so as to avoid the top are configured in the strictly same manner as the above-described embodiment.

In the shorts of the embodiment also, the effects that a three-dimensional effect can be produced around the buttock lower portion and the gluteal groove portion, that the hip hemline 15*a* can be satisfactorily prevented from rising, that loose wrinkles and bugginess in the buttock lower portion are hardly produced in a standing posture, and that a beautiful hip hemline can be obtained can be attained in the same manner as the above-described embodiment.

In the above-described embodiments, the front and back bodies 11 and 12 are sewn to each other at the seamlines L. Alternatively, the front body 11 may not be a single fabric which is continuous between the right and left edges, or the above-described shape of the front body 11 may be formed by sewing.

The invention is not restricted to shorts, and may be similarly applied to a bathing suit, and may be similarly applied also to briefs for men.

INDUSTRIAL APPLICABILITY

According to the invention, even when vigorous motion is performed after wearing, the hip hemline does not rise so that it is comfortable to wear, loose wrinkles and bugginess in the buttock lower portion and the gluteal groove portion are hardly produced even in a standing posture, and a beautiful hip hemline can be obtained. The invention is particularly suitable to shorts and a bathing suit.

What is claimed is:

1. An article of clothing comprising:

a stretchable front body including right and left front lower end edge portions;

right and left leg openings formed in the stretchable front body, wherein each opening is oriented in a downward fashion and is located so that the openings are positioned in a bilaterally symmetrical manner in the stretchable front body, wherein each opening is bordered by a hip hemline lower end portion that provides an inner periphery that forms the corresponding opening, wherein each right and left front lower end edge portion extends in a first curvilinear fashion from a vertical intermediate position to a respective hip hemline lower end portion so that each front lower end edge portion extends as a curved edge that has an outwardly convex upper curvilinear portion and a lower curvilinear portion, wherein the lower curvilinear portion is disposed below the outwardly convex upper curvilinear portion and has a linear shape;

a stretchable back body including right and left back lower end edge portions, wherein each right and left back lower end edge portion extends in a second curvilinear fashion from a vertical intermediate position to a respective hip hemline lower end portion so that each back lower end edge portion extends in a downward spreading manner thereby forming a shape having diverging edges, and the stretchable back body has a first width (P) between the right and the left back lower end edge portions and the stretchable front body has a second width (H) between the right and the left front lower end edge portions, wherein the width (P) is dimensioned to fall within the range of equal to or larger than 0.6 times width (H) and equal to or smaller than 6 times width (H); and a sewn seamline connects the right and the left front lower end edge portions to a respective one of the right and the left back lower end edge portions, wherein each seamline is formed so as to elongate from back waist portions of the article to a respective hip hemline lower end portion and each seamline has an outward detouring around a respective buttock top portion of the article of clothing.

2. An article of clothing comprising:

a stretchable front body including right and left front lower end edge portions;

right and left leg openings formed in the stretchable front body, wherein each opening is oriented in a downward fashion and is located so that the openings are positioned in a bilaterally symmetrical manner in the stretchable front body, wherein each opening is bordered by a hip hemline lower end portion that provides an inner periphery that forms the corresponding opening, wherein each right and left front lower end edge portion extends in a first curvilinear fashion from a vertical intermediate position to a respective hip hemline lower end portion so that each front lower end edge portion extends as a curved edge that has an outwardly convex upper curvilinear portion and a lower curvilinear portion, wherein the lower curvilinear portion is disposed below the outwardly convex upper curvilinear portion and has a curved shape;

stretchable back body including right and left back lower end edge portions, wherein each right and left back lower end edge portion extends in a second curvilinear fashion from a vertical intermediate position to a respective hip hemline lower end portion so that each back lower end edge portion extends in a downward spreading manner thereby forming a shape having diverging edges, and the stretchable back body has a first width (P) between the right and the left back lower end edge portions and the stretchable front body has a second width (H) between the right and the left front lower end edge portions, wherein the width (P) is dimensioned to fall within the range of equal to or larger than 0.6 times width (H) and equal to or smaller than 6 times width (H); and a sewn seamline connects the right and the left front lower end edge portions to a respective one of the right and the left back lower end edge portions, wherein each seamline is formed so as to elongate from back waist portions of the article to a respective hip hemline lower end portion and each seamline has an outward detouring around a respective buttock top portion of the article of clothing.

* * * * *